United States Patent [19]

Brien

[11] Patent Number: 4,740,933

[45] Date of Patent: Apr. 26, 1988

[54] FLEXIBLE BAND WITH ELECTRICAL CIRCUIT FOR A TIME PIECE

[76] Inventor: André Brien, 1390 boulevard de la Concorde ouest, Apt. 2, Laval-des-Rapides, Quebec, Canada, H7N 5P5

[21] Appl. No.: 53,802

[22] Filed: May 26, 1987

[51] Int. Cl.[4] ..... G04B 19/30

[52] U.S. Cl. ..... 368/67; 368/227

[58] Field of Search ..... 368/67, 222, 227, 224, 368/88, 204

[56] References Cited

U.S. PATENT DOCUMENTS

| | | | |
|---|---|---|---|
| 4,043,113 | 8/1977 | Hart | 368/88 |
| 4,053,688 | 10/1977 | Perkins et al. | 368/88 |
| 4,122,664 | 10/1978 | Stampfl | 368/88 |
| 4,247,928 | 1/1981 | Dorfman | 368/67 |
| 4,272,841 | 6/1981 | Nickles | 368/88 |
| 4,435,088 | 3/1984 | Dorfman | 368/88 |

FOREIGN PATENT DOCUMENTS

| | | | |
|---|---|---|---|
| 63784 | 5/1980 | Japan | 368/88 |

*Primary Examiner*—Bernard Roskoski

[57] ABSTRACT

An electrical conductive circuit for use in a wristwatch and wherein the circuit comprises an elongated flat electrically conductive band formed from a conductive strip having opposed electrical insulating layers. The band also has a component attachment region and a pair of battery terminals. The band is also formed as a flexible band which is adaptable to be configured to fit in a slot area of a wristwatch.

17 Claims, 2 Drawing Sheets

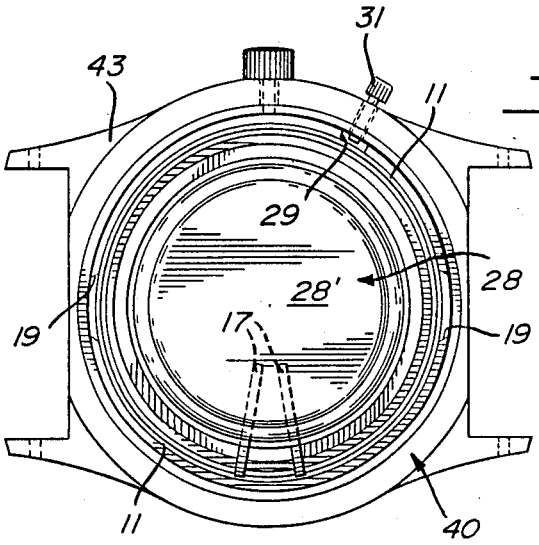
FIG. 4
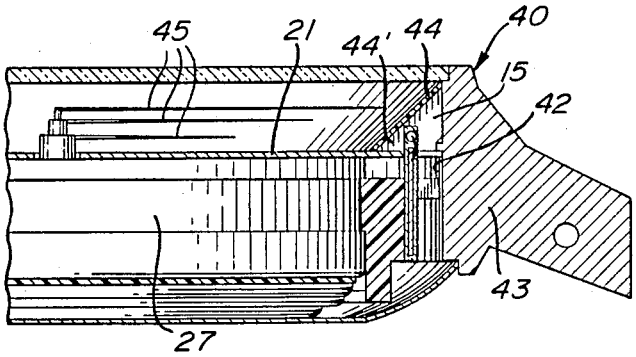
FIG. 5
FIG. 6
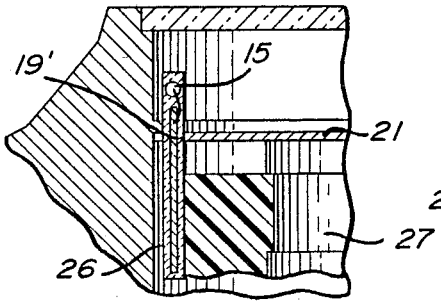
FIG. 7
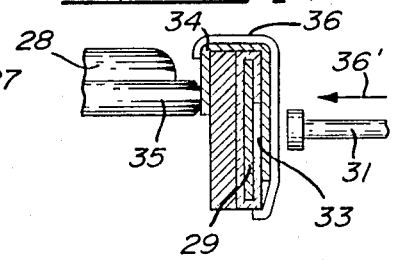

FLEXIBLE BAND WITH ELECTRICAL CIRCUIT FOR A TIME PIECE

BACKGROUND OF THE INVENTION

1. Field of Invention

The present invention relates to an electrical conductive circuit which comprises an elongated flat electrically conductive band formed from a conductive strip having opposed electrically insulating layers, and particularly for use with a wristwatch for establishing electrical contact between an electrical component element and a battery.

2. Description of Prior Art

It is well known in the prior art to incorporate electrical components in wristwatches whereby to illuminate the dial of a wristwatch, to perform an electrical switching function, or for other uses. All of these electrical components require wiring in order to connect a battery thereto to provide electrical power to these components. A disadvantage is that the wiring is often bulky and difficult to incorporate within a wristwatch, sometimes impairs the functioning of the watch if it is displaced and obstructs an operating part of the wristwatch, may become disconnected or break, and is often difficult to install and repair. In my copending Canadian application Ser. No. 522,603 filed Nov. 10, 1986 and relating to a portable time piece having a light diffuser member therein, there is shown a typical example of the use of conventional miniature electrical components and wiring within a wristwatch.

SUMMARY OF INVENTION

It is a feature of the present invention to provide an electrical conductive circuit which substantially overcomes the above-mentioned disadvantages of the prior art.

Another feature of the present invention is to provide a flat insulated conductive strip which can be inserted in the casing of a watch about the movement holder and the casing insert wall and retained by the slot, or glued, or connected at its free ends.

Another feature of the present invention is to provide an electrical conductive circuit constructed of a flat conductive band formed from a conductive strip having opposed electrically insulating layers and wherein the band may be inserted in a small slot area of a wristwatch which does not interfere with the operating mechanism of the watch.

Another feature of the present invention is to provide an electrical conductive circuit formed from an electrically conductive band comprised of a conductive strip having opposed electrically insulating layers and wherein the band has integrally formed therewith a component attachment region, a connector region for interconnecting the free ends of the band to form a closed loop, and one or a pair of battery terminals.

According to the above features, from a broad aspect, the present inventon provides an electrical conductive circuit for use in a wristwatch. The circuit comprises an elongated flat electrically conductive band formed from a conductive strip having opposed electrically insulating layers on each side of the conductive strip. A component attachment region is also integrally formed with the band as well as at least one battery terminal. The conductive band is a flexible band adaptable to be configured to fit in a slot area of a wristwatch.

BRIEF DESCRIPTION OF DRAWINGS

A preferred embodiment of this invention will now be described with reference to the examples thereof as illustrated in the accompanying drawings in which:

FIG. 4 is a fragemented section view showing the conductive band installed in the casing of a wristwatch;

FIG. 5 is a fragmented section view showing the conductive band installed within a wristwatch casing;

FIG. 6 is a fragmented section view showing an alternative installation of the electrically conductive band in a slot area of a wristwatch; and FIG. 7 is a fragmented section view showing an alternative construction of a switch contact arrangement.

DESCRIPTION OF PREFERRED EMBODIMENTS

Figure 1A:
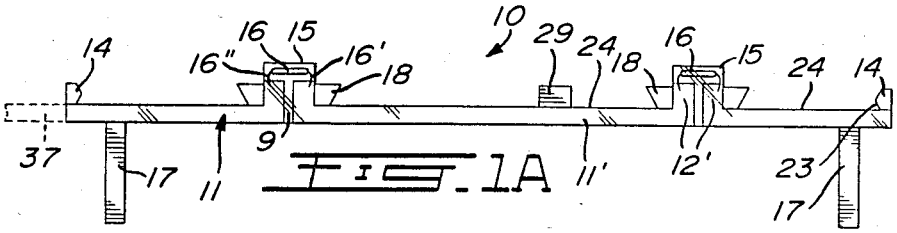
FIG. 1A is a plan view of the electrical conductive band of the present invention.
Figure 1B:
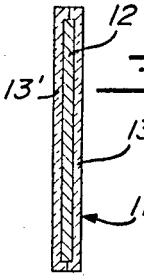
FIG. 1B is a section view of the band.
Figure 2:
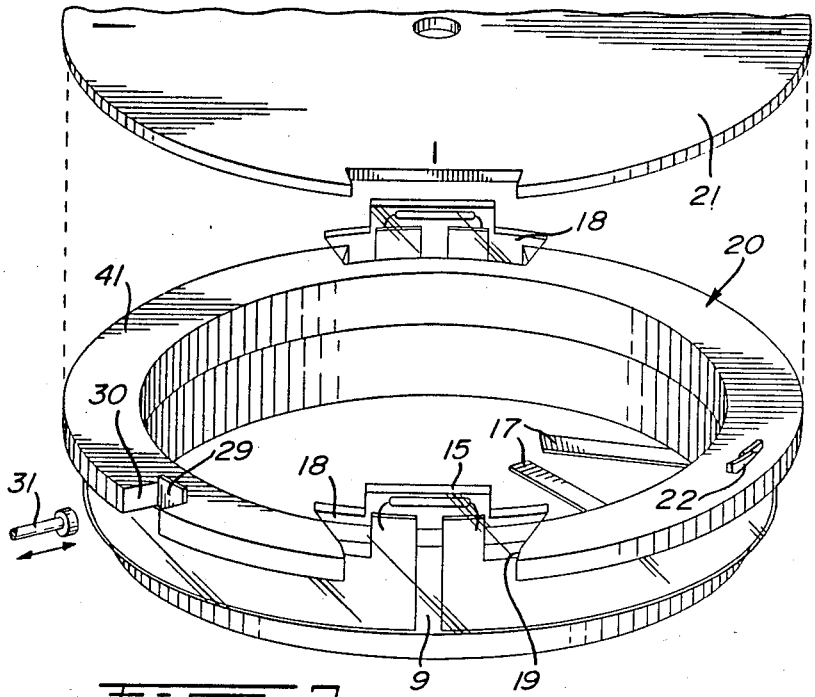
FIG. 2 is a perspective exploded view, partly fragmented, showing the electrically conductive band secured about a ring positioned under a dial face of a wristwatch.

Referring now to the drawings, and more particularly to FIGS. 1A through 3B, there is shown generally at 10 the electrically conductive circuit of the present invention. The circuit comprises an elongated flat electrically conductive band 11 having a conductive strip 12 protected on opposed sides thereof by electrically insulating layers 13 and 13' of plastic or other insulating material. Connector means 14 may be integrally formed at each end of the band for interconnecting the free ends of the band to form a closed loop electrical circuit as illustrated in FIG. 2. However, the band need not form a closed loop depending on its intended use. The band also has integrally formed therwith a component attachment means in the form of spaced-apart elevated attachment tab 15 forming an open-circuit 9 therebetween whereby to support an electrical component, such as the miniature lamp 16, thereon and in electrical contact with the conductive strip 12 or terminal ends 12' of the conductive strip. A pair of battery terminals 17 is also integrally formed with the band 11 for connection to a battery, as will be described later.

The component attachment tab 15 is formed integral in a side edge of the band 11 and protrudes thereabove. This attachment tab 15 is also provided with a pair of opposed attachment shoulders 18 to engage with a locating slot 19, as shown in FIG. 2, and provided within a support ring 20 positionable within a wristwatch casing, or in a slot 19' as shown in FIG. 6, provided in a peripheral portion of a dial face 21 of a wristwatch whereby to situate the miniature lamp 15 above a dial face for illumination of the dial face area. As shown in FIG. 1A the attachment shoulder 18 has an outwardly tapered edge extending outwardly a predetermined distance so as to wedge the tab into the locating slot to maintain the miniature lamp 16 at a desired position.

In one embodiment, the connector 14 as herein shown is formed integral with the band 11 at an adjacent end thereof. The connector 14, as well as the attachment shoulders 18, are merely formed from fused insulating portions of the insulating layers 13 and 13'. The connectors 14 also extend above a side edge of the band and, as herein shown, are formed as tabs for sliding retention fit within a retention slot 22 formed peripherally of the dial face 21 or on the retention ring 20, as shown in FIG. 2.

Figure 3A:
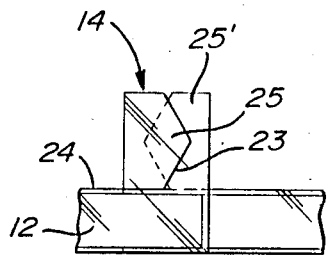
FIG. 3A is a fragmented end view of the connectors interconnected together to secure the band in a closed loop.

As shown in FIG. 3A, the connector tab 14 is formed with an attachment undercut or slot 23 facing inwardly of the band and located immediately above the side edge 24 of the band. An inwardly facing attachment wall portion 25 is located above the slot 23. When the opposed connectors are secured together by looping the band 11 and disposing the attachment wall portions 25 and 25' in facial overlap contact with the attachment slots 23 interconnected, the band 11 is secured to form a loop as shown in FIG. 2. This loop may then be positioned within the slot area 26 in the peripheral region of the watch movement 27, as shown in FIG. 6, or about the retention ring 20 as shown in FIG. 2.

Referring now additionally to FIGS. 4 and 5, the battery terminals 17 are constituted by at least one substantially transverse elongated extension arms, herein two arm 17, formed integral with the band 11 and positioned adjacent the free ends of the band. The extension arms have at least a battery contact portion in which the conductive strip 12 is exposed for contact with a battery terminal end 28 (see FIG. 4), or a conductive element, such as the casing, in contact with the battery end terminal 28.

As shown in FIG. 1A, a switch contact tab 29 is also formed integral with the band 11 and has a conductive strip portion extending therein. It is also formed in the side edge 24 of the band. However, it is to be understood that the switch contact tab 29 as well as the connectors 14 may extend on the other side edge of the band. The conductive strip portion 11' comprising the switch contact tab 29 is connected to the lead terminal 16' of both miniature lamps 16 and forms a common conductive circuit. The other lead terminal 16'' of each lamp 16 connects to a respective one of the battery terminals 17. These battery terminals 17 are both in contact the negative terminal the battery 28 as shown in FIG. 4. However, the tab 29 is positioned within a locating switch slot 30 formed in the ring 20 and is engageable by a switch contact element 31 which, when in contact with the tab 29, establishes contact with the positive terminal 28' of the battery 28 through the casing in contact therewith and thus completes the circuit by positioning each of the lamps 16 across the battery terminals to cause the lamps to illuminate.

FIG. 7 shows a modified version of this switch contact and wherein the contact is formed by an opening 33 formed in the outer insulating layer 13 of the band 11 whereby to expose the conductive strip 13. A further conductive strip 34 is positioned to overlap the opening 33 and contact the positive terminal 35 of the battery 28. Both conductive strips 34 and 13 are isolated from each other by the gap formed by the opening 33. By depressing a switch contact 31 in the direction of arrow 36 the conductive strip 34 will move inwardly in the opening 33 and contact the conductive strip 13 and thus complete the circuit. An insulating layer 36 is also positioned over the electrical conductive strip 34.

Figure 3B:
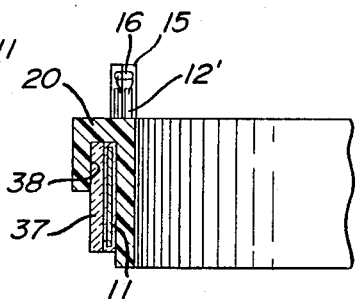
FIG. 3B is a fragmented section view showing another alternative of the end connectors of the band to secure the band in a closed loop.

Referring to FIG. 3B there is shown an alternative construction of the connector means and, as herein shown, instead of providing connector tabs 14, a free end portion of the elongated band 11 may have an extension portion 37 which overlaps the opposed end portion of the band when the bands are located within a slot 38 formed in the retention ring 20. The overlap portion 37 may be glued to the open portion. Also, the entire band may be glued to the retention ring 20 or the casing after installation. Therefore, it is not necessary for the band to form a closed loop or have connector means at its free ends and the bands could terminate at ends 8, shown in phantom lines, when positioned in the wristwatch casing about the movement casing, the ends 8 would be spaced from one another. This may be desirable to accomodate the stem 8 of the crown 6 usually found in wristwatches.

In my earlier referred to patent application there is disclosed the use of a retention ring and a light diffuser in a wristwatch for illuminating the dial face 21 of the wristwatch. In an embodiment of my invention the electrically conductive strip is securable about such a support ring which is associated with a wristwatch 40, such as shown in FIGS. 4 and 5. A support ring may have various configurations such as shown in FIGS. 2, 3B, and 5, and may be formed with a top flange wall 41 in which slot openings may be formed to receive various tabs associated with the elongated band 11. This ring is usually positioned between the time piece movement 27 and the inside wall 42 of the casing 43. As shown in FIG. 5, the light diffusing ring 44 is positioned circumferentially about the dial face 21 and the miniature lamp 15 and its support tab is located within a cavity 44' of the light diffusing ring 44 whereby to illuminate the dial face and the dials 45 extending thereabove.

It is also conceived that the conduction band be provided with a terminal to transfer the voltage from a battery cell to an existing battery cell to as existing battery terminal of a wristwatch movement either directly of through a voltage divider or regulator.

It is within the ambit of the present invention to provide obvious modifications of the examples of the preferred embodiment described herein, provided such modifications fall within the scope of the appended claims.

I claim:

1. An electrical conductive circuit for use in a wristwatch, said circuit comprising an elongated flat electrically conductive band formed from a conductive strip having opposed electrically insulating layers on each side of said conductive strip; a component attachment means formed with an open-circuit in said conductive band and an electrical component supported by said attachment means across said open-circuit, said conductive band having one battery terminal on one side of said open-circuit and switch means to connect an opposed side of said open-circuit to an opposed battery terminal to connect said terminals across said electrical component, said conductive band being a flexible band adaptable to be configured to fit in a peripheral area of a wristwatch.

2. An electrically conductive circuit as claimed in claim 1, wherein said band has integrally formed connector means for interconnecting the free ends of said band to form a closed loop.

3. An electrically conductive circuit as claimed in claim 2, wherein said component attachment means is an elevated tab formed integral in a side edge of said band and protruding thereabove, there being two separated conductive strip portions isolated from one another and extending in said elevated tab.

4. An electrically conductive circuit as claimed in claim 3, wherein said component is a miniature lamp.

5. An electrically conductive circuit as claimed in claim 3, wherein said band has a switch contact tab formed integral with said conductive strip to connect to said switch means.

6. An electrically conductive circuit as claimed in claim 5, wherein said switch contact tab is an elevated extension formed integral in a side edge of said band and protruding thereabove.

7. An electrically conductive circuit as claimed in claim 3, wherein an opening is formed in one of said insulating layers to expose said conductive strip, and switch means to contact said conductive strip through said opening to establish an electrically conductive circuit with a battery terminal connected to said switch means.

8. An electrically conductive circuit as claimed in claim 4, wherein said elevated tab constituting said component attachment region is formed with said insulating layers shaped to define at least one attachment shoulder to engage with a locating slot formed in said wristwatch peripherally of a dial face thereof whereby said lamp is situated above said dial face to illuminate same.

9. An electrically conductive circuit as claimed in claim 8, wherein there are two of said attachment shoulder one formed in each of opposed side edges of said elevated tab, said shoulder having an outwardly tapered edge extending outwardly a predetermined distance so as to wedge said tab into said locating slot.

10. An electrically conductive circuit as claimed in claim 2, wherein said connector means is at least one connector tab extending above a side edge of said band adjacent an end thereof, said connector tab being formed by at least one of said opposed electrically insulating layers.

11. An electrically conductive circuit as claimed in claim 10, wherein a connector tab is provided at each free end of said conductive band.

12. An electrically conductive circuit as claimed in claim 11, wherein said connector tab is configured for sliding retention fit within a retention slot formed in said wristwatch peripherally of a dial face thereof.

13. An electrically conductive circuit as claimed in claim 11, wherein said connector tab is formed with an attachment slot facing inwardly of said band and located immediately above said side edge of said band, and an inwardly facing attachment wall portion above said attachment slot, said opposed connector being secure together by looping said band and disposing said attachment wall portions in facial overlap contact with said attachment slots being in mating engagement.

14. An electrical conductive circuit as claimed in claim 3, wherein there are two battery terminals formed by two substantially transverse elongated extension arms formed integral with said conductive strip and positioned adjacent opposed free ends of said band, said extension arms having at least a battery contact portion in which said conductive strip is exposed for contact with a battery terminal or a conductive element in contact with said battery terminal.

15. An electrical conductive circuit as claimed in claim 3, wherein said electrically conductive band is securable in a support ring associated with a wristwatch, said support ring having a circumferential top flange wall with slot openings formed therin, said elevated tab extending into one of said slot openings to support said component elevated above said top flange wall, said connector means being a connector tab formed at a free end portion of said band and extending above a side edge of said band on a common side as said elevated tab, said connector tabs being received in a common one of said slots to retain said band about said support ring.

16. An electrical conductive circuit as claimed in claim 3, wherein said connector means is constituted by at least an end extension portion of said band for overlapping the other free end of said band when said band is positioned within a circumferential retention slot of a wristwatch.

17. An electrical conductive circuit as claimed in claim 16, wherein said retention slot is provided in a retention ring disposed in said wristwatch under a dial face of said wristwatch.

* * * * *